US006834527B2

(12) United States Patent
Hopwood

(10) Patent No.: US 6,834,527 B2
(45) Date of Patent: Dec. 28, 2004

(54) TUBE BENDER WITH ADJUSTABLE MECHANICAL STOP

(75) Inventor: Gregory Hopwood, 1743 Snyder Corner Rd., Windsor, PA (US) 17366

(73) Assignee: Gregory Hopwood, Windsor, PA (US)

( * ) Notice: Subject to any disclaimer, the term of this patent is extended or adjusted under 35 U.S.C. 154(b) by 0 days.

(21) Appl. No.: 10/760,569

(22) Filed: Jan. 20, 2004

(65) Prior Publication Data

US 2004/0182129 A1 Sep. 23, 2004

Related U.S. Application Data

(60) Provisional application No. 60/455,966, filed on Mar. 19, 2003, and provisional application No. 60/456,011, filed on Mar. 19, 2003.

(51) Int. Cl.[7] ..... B21D 7/02
(52) U.S. Cl. ..... 72/459; 72/458
(58) Field of Search ..... 72/458, 459

(56) References Cited

U.S. PATENT DOCUMENTS 2,656,747 A * 10/1953 Lewin ..... 72/459
2,666,351 A * 1/1954 Lewin et al. ..... 72/459
2,847,705 A 8/1958 Hellwig
2,932,225 A 4/1960 Gardner
2,953,048 A 9/1960 Brown
3,590,617 A 7/1971 Mount
4,052,881 A 10/1977 Mount
4,321,820 A * 3/1982 Nason ..... 72/459
4,425,784 A 1/1984 D'Gerolamo
4,442,695 A 4/1984 Gardner
4,452,064 A 6/1984 Custin
5,669,258 A 9/1997 Luebke
5,927,141 A 7/1999 Walsten
6,422,054 B1 7/2002 White
6,446,483 B1 9/2002 Ericksen

* cited by examiner

*Primary Examiner*—David Jones
(74) *Attorney, Agent, or Firm*—Joseph E. Maenner; Monte & McGraw, P.C.

(57) ABSTRACT

An adjustable mechanical stop for a tube bender is disclosed. The tube bender includes an elongated arm having a pivoting end and a free end, wherein the pivoting end is pivotally connectable to a tube bender. A stop is disposed at the free end of the elongated arm, wherein the stop is disposed to engage a tube in the tube bender. A lock is disposed along the elongated arm, wherein the lock is engageable with the tube bender to adjustably secure the stop relative to the tube bender. A tube bender incorporating the mechanical stop is also disclosed.

16 Claims, 5 Drawing Sheets

TUBE BENDER WITH ADJUSTABLE MECHANICAL STOP

CROSS REFERENCE TO RELATED APPLICATON

The present application claims the benefit of U.S. Provisional Patent Application Ser. No. 60/455,966, filed Mar. 19, 2003 and claims benefit of 60/456,011 filed Mar. 19, 2003.

FIELD OF THE INVENTION

The present invention relates to a tube bender with a mechanical stop that is adjustable along the length of the tube bender head.

BACKGROUND OF THE INVENTION

During installation of metal conduit, such as small diameter piping or conduit for electrical cables, it is often more economical to be able to bend the conduit rather than to cut the conduit and install fittings to effect the required bends. Oftentimes, a conduit bending tool is employed to make the desired bends. The bending tool typically includes an elongated handle with a bender head affixed to one end of the handle. The bender head is typically an arc-shaped channel into which a generally straight length of conduit is inserted. The channel includes a plurality of arcuate designations inscribed on the side of the channel, corresponding to degrees of bending of the conduit in the bender head.

In use, a conduit is inserted into the bender head and the conduit is rotated relative to the bender head so that the conduit bends along the bender head. Typically, the force required to bend the conduit is force readily provided by an average sized person leaning against either the conduit or the bender, as is well known in the art. When the conduit is bent a desired amount, the force being applied to bend the conduit is released, and the conduit is then removed from the bender. Typically, conduit having a nominal size of up to 1¼ inches (approximately 3.2 centimeters) can be bent in this manner.

However, one problem experienced by personnel using such a tool and method to bend conduit is that it is often necessary to repeat a particular bend angle for multiple bends, such as to bend the conduit around an obstruction. Such bends are known as offset bends, three-point saddles, and four point saddles. It is desirous to be able to make all of these bends at equal angles to provide a professional appearance and to ensure that the conduit is bent in the proper amount over each of several locations. The person making the bend must estimate the amount of each of the several bends, which can lead to errors in the final configuration of the conduit, and provide an unprofessional appearance in the conduit configuration.

One approach to solving this problem is disclosed in U.S. Pat. No. 6,422,054 to White. White discloses a conduit bending tool that uses a bending block that is removably insertable into one of a plurality of notches inscribed along a bender head. However, White's bending tool is separable from the bender head and may become misplaced between uses. Further, White's bending tool is only applicable in discrete increments and cannot be used to accurately locate angles between those discrete increments. It would be beneficial to provide a stop mechanism for a conduit bender that is fixedly connected to the bender, and that may be positioned at an infinite amount of locations along the bender head.

BRIEF SUMMARY OF THE INVENTION

Briefly, the present invention provides an adjustable mechanical stop for a tube bender. The stop comprises an elongated arm having a pivoting end and a free end, wherein the pivoting end is pivotally connectable to a tube bender. A stop is disposed at the free end of the elongated arm, wherein the stop is disposed to engage a tube in the tube bender. A lock is disposed along the elongated arm, wherein the lock is engageable with the tube bender to adjustably secure the stop relative to the tube bender.

Further, the present invention provides an adjustable mechanical stop for a tube bender. The stop comprises a generally U-shaped body having a closed end and an open end, wherein the open end is pivotally connectable to a tube bender and wherein the closed end is disposed to engage a tube in the tube bender. A lock is disposed along the generally U-shaped body, wherein the lock is engageable with the tube bender to adjustable secure the generally U-shaped body relative to the bender.

Also, the present invention provides an improved tube bender. The bender comprises a tube bender and an adjustable stop. The tube bender includes a handle having a free end and a connected end and a bender head connected to the connected end of the handle. The bender head includes an arcuate channel sized to allow a tube to be disposed therein. The stop includes an elongated arm having a pivoting end pivotally connected to the tube bender and a free end disposed to travel along the arcuate channel and a stop member connected to the free end of the elongated arm such that the stop member is traversable along the arcuate channel. The stop member also includes a lock disposed along the elongated arm, wherein the lock is engageable with the bender head to adjustably lock the stop relative to the bender head such that, when a tube is disposed within the arcuate channel and bent along the arcuate channel, the stop member engages the tube at a desired location and prevents further bending of the tube along the arcuate channel.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
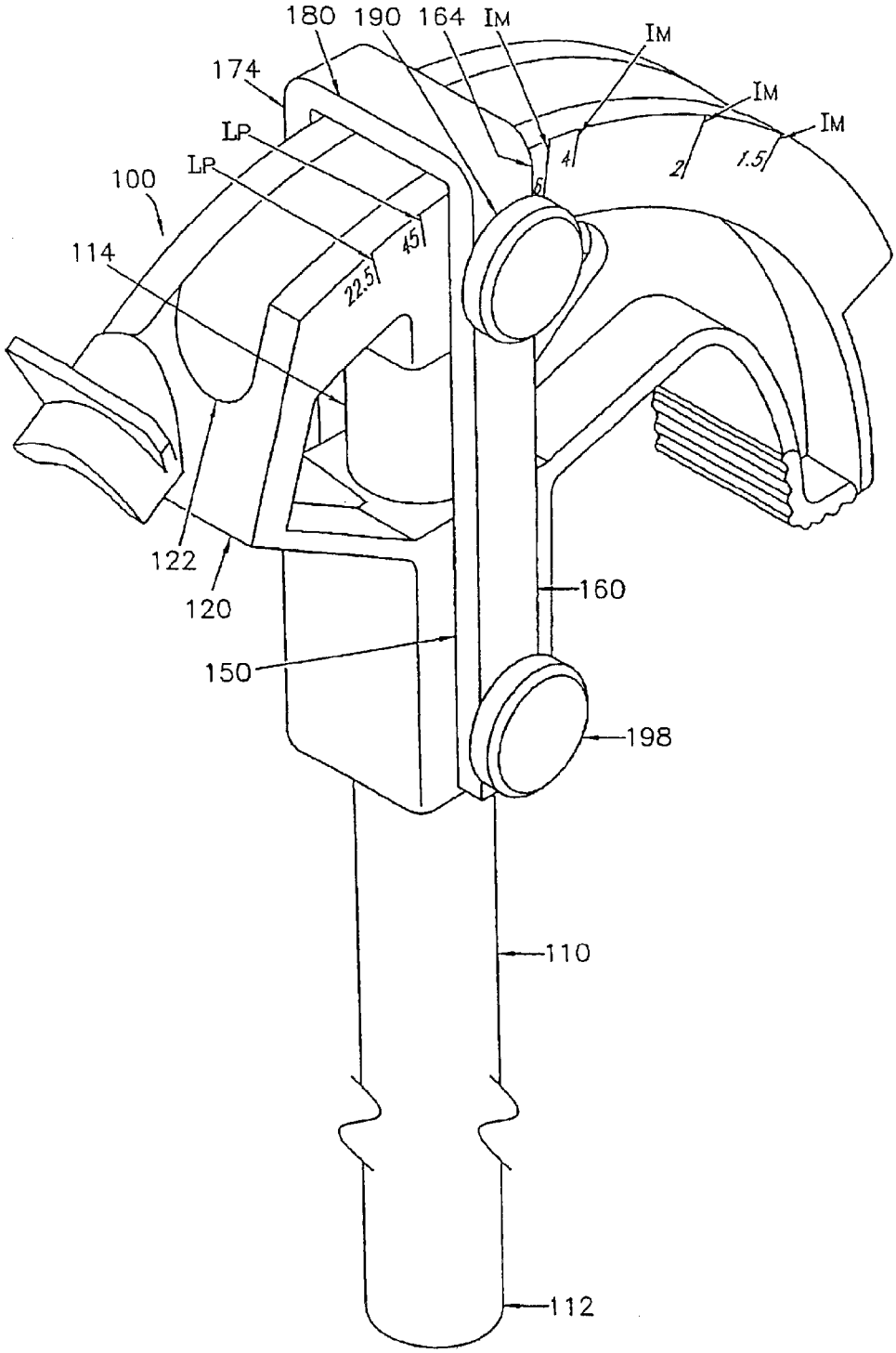
FIG. 1 is a perspective view of a tube bender with mechanical stop according to a first preferred embodiment of the present invention.

In the drawings, like numerals indicate like elements throughout. Referring to FIGS. 1–4, a tube bender 100 with an adjustable mechanical stop 150 according to a preferred embodiment of the present invention is shown. The tube bender 100 includes an elongated handle 110 having a free end 112 and a connected end 114. The handle 110 may be constructed preferably from tubular steel or other suitable material. A bender head 120 is disposed on the connected end 114 of the handle 110. Preferably, the bender head 120 is constructed from cast iron or other suitable material, such as aluminum. The bender head 120 includes an arcuate channel 122 having a first sidewall 124 and a second sidewall 126. The arcuate channel 122 is sized to accept standard sizes of tube (not shown) that are to be bent by the tube bender 100. Typically, such tube may be used as conduit for running electrical wires or cabling, although those skilled in the art will recognize that the tube may be used for other purposes, such as for fluid transport.

The arcuate channel 122 further includes an enclosed end 128 that is sized to allow the tube that is to be bent to be disposed within the arcuate channel 122 from the closed end 128 (from right to left along arrow "A" in FIG. 2) so that the tube may be arcuately bent along the arcuate channel 122.

Figure 2:
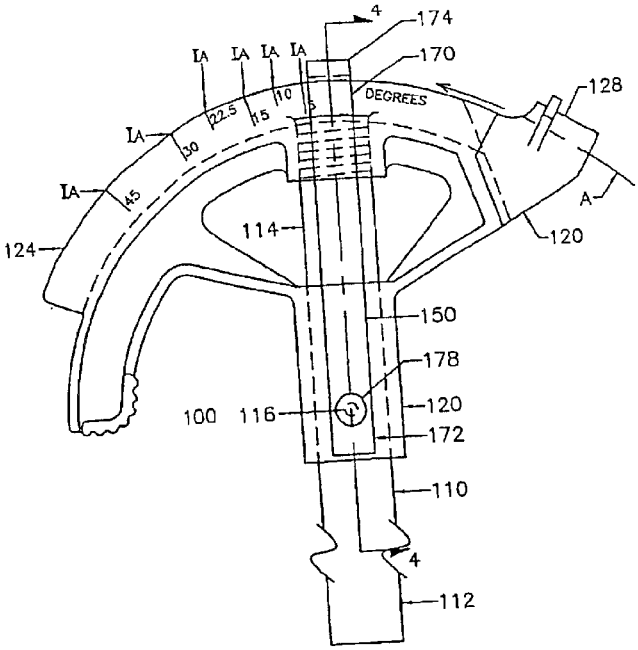
FIG. 2 is a front elevational view of the tube bender with mechanical stop shown in FIG. 1.

Referring to FIGS. 1 and 2, preferably, angle indicating indicia "$I_A$" are disposed along an exterior of the first sidewall 124 of the bender head 120. The angle indicating indicia $I_A$ may be inscribed in the first sidewall 124, raised from the first sidewall 124, or affixed to the first sidewall 124 by other means. Typical angle indicating indicia $I_A$ are markings setting off tube bends of preferably 5, 10, 15, 22.5, 30, and 45 degrees from the closed end 128, although those skilled in the art will recognize that additional and/or alternate degree increments may be used.

Further, to assist in bending offsets and three- and four-point saddles, multiplier indicating indicia "$I_M$", which are known in the art, may additionally be disposed along the exterior of the second sidewall 126 of the bender head 120. Exemplary multiplier indicating indicia $I_M$ are markings setting off bends at multipliers of 1.5, 2, 4, 6, 8, and 10. While a common bend of 15 degrees has a multiplier of approximately 3.86, the simplified multiplier of the whole number 4 results in a bend between about 14 and 15 degrees, which is sufficiently close to the desired bend of 15 degrees for most tube bending work. Further, while the multiplier 1.41 is typically used for a 45 degree bend, the simplified multiplier of 1.5 generates a bend between 44 and 45 degrees. The multiplier 6 generates a bend between 9 and 10 degrees; the multiplier 8 generates a bend between 6 and 7 degrees; and the multiplier 10 generates a bend between 5 and 6 degrees. Also, locator points $L_P$ for 22.5 and 45 degree bends are preferably located on the second sidewall 126 to assist in making three-point saddles, as will be described in more detail later herein.

Those skilled in the art will recognize that the angle indicating indicia $I_A$ and the multiplier indicating indicia $I_M$ may alternatively be disposed along the exteriors of both of the first and second sidewalls 124, 126, respectively, of the bender head 120.

Further, the angle indicating indicia $I_A$ and the multiplier indicating indicia $I_M$ may be slightly offset from their true locations along the sidewalls 126, 126 in order to account for varying springback in the tube due to manufacturing variables in the tube that is being bent. Springback is a naturally occurring phenomenon that occurs in many materials, particularly in the metals from which a typical tube is formed. The material retains some shape memory and attempts to return to its original, pre-bent position, by "springing back" toward the original, prebent position by up to several degrees. By offsetting the locations of the angle indicating indicia $I_A$ and the multiplier indicating indicia $I_M$ on the sidewalls 124, 126, and using calculations and tables known to those skilled in the art, the typical springback is taken into account without the need for the user to overcompensate the bend.

The stop 150 is generally U-shaped and includes a first elongated arm 160 having a first pivoting end 162 and a first free end 164. The first elongated arm 160 is disposed along one side of the bender head 120. A second elongated arm 170 extends generally parallel to the first elongated arm 160, and includes a second pivoting end 172 and a second free end 174. The second elongated arm 170 is disposed along an opposing side of the bender head 120. The first and second pivoting ends 162, 172 each include a preferably rounded opening 166, 176, respectively, extending therethrough so that a pivoting member 178, such as a bolt or a screw, may be inserted through each of the openings 166, 176 to pivotally retain the first and second pivoting ends 162, 172 against the base of the bender head 120 as a pivot point 116. While it is preferred that the stop 150 is pivotally connected to the bender head 120, those skilled in the art will recognize that, depending of the radius of curvature of the arcuate channel 122, the stop 150 may alternatively be pivotally connected to the handle 110. For example, for tight bends with a small radius of curvature, the lengths of the first and second elongated arms 160, 170 are necessarily short, enabling the stop 150 to be pivotally mounted to the bender head 120.

A mechanical stop member 180 at the closed end of the U-shape of the stop 150 connects the first free end 164 and the second free end 174. Optionally, the stop member 180 may include a generally U-shaped channel (not shown) to allow a tube or pipe being bent in the tube bender 100 to be inserted against the curved portion of the channel during bending.

A locking member 190, such as a thumb screw, is disposed proximate to the first free end 164 and generally perpendicular to the length of the first elongated arm 160. The locking member 190 is releasably engageable with one of the sidewalls 124, 126 of the bending head 120 of the tube bender 100 in a frictional engagement to secure the stop 180 in a desired position along the bending head 120. While a single locking member 190 engageable with one of the sidewalls 124, 126 is preferred, those skilled in the art will recognize that a second locking member (not shown) engageable with the other of the sidewalls 124, 126 may be used.

Preferably, the mechanical stop 150 is constructed from steel, extruded aluminum, or some other suitable material that will not generally deform through use.

Optionally, a locking member 198 may be connected to the bender head 120 such that, when the mechanical stop 150 is pivoted about the pivoting member 178 so that the stop member 180 is proximate to the handle 110, the locking member 198 engages at least one of the elongated arms 160, 170 to secure the mechanical stop 150 proximate to the handle 110. Preferably, the locking member 198 may be a thumb screw, although those skilled in the art will recognize that other locking members, such as a retaining clip, may be used.

Figure 5:
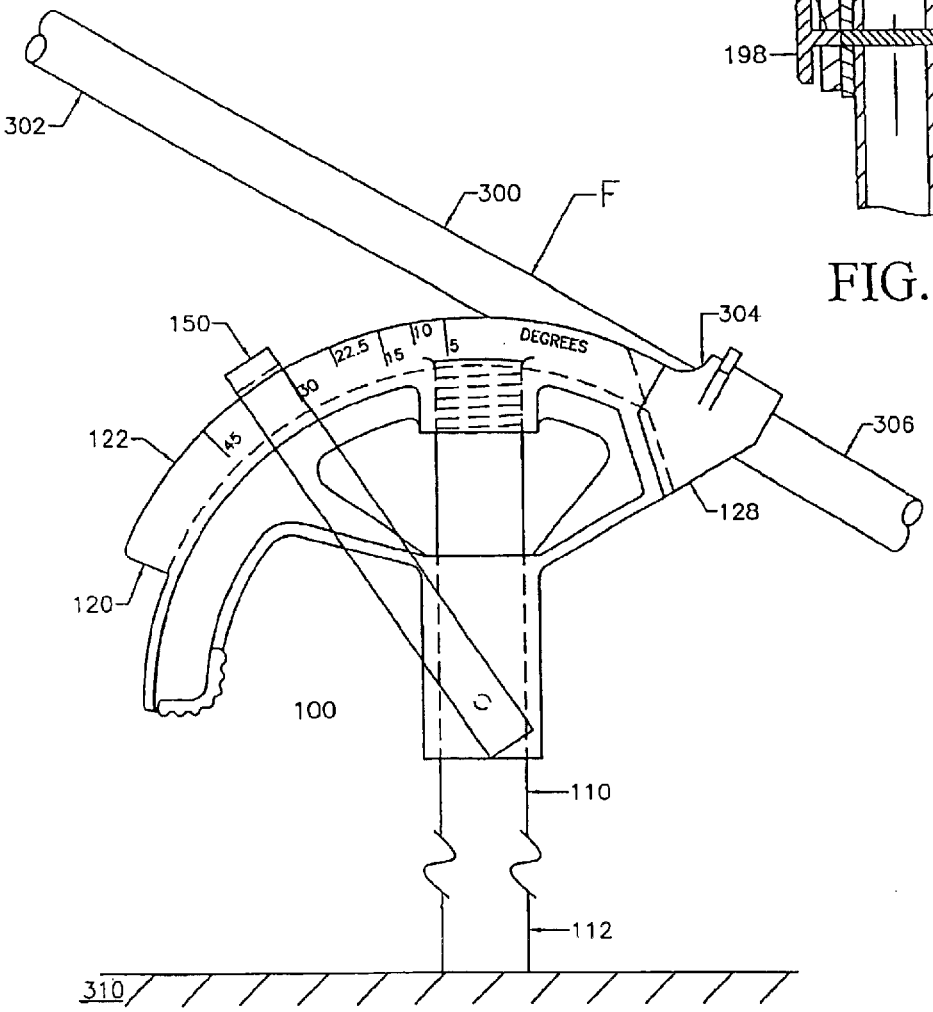
FIG. 5 is a front elevational view of the tube bender of FIGS. 1–4, with a tube inserted therein.

To operate the tube bender 100, an operator disengages the locking member 198 from the mechanical stop 150 and pivots the mechanical stop 150 along the pivoting member 178 so that the mechanical stop 150 is disposed at a predetermined location along the arcuate channel 122 of the bender head 120. An edge of either of the first or second elongated arms 160, 170 may be aligned with alignment marks of the respective sidewall 124, 126 that correspond to the desired angle indicating indicia $I_A$ or multiplier indicating indicia $I_M$ Preferably, as seen in FIG. 5, the edge of the first or second elongated arms 160, 170 that is aligned with the alignment marks is the edge closer to the closed end 128. The predetermined location is determined according to either the angle indicating indicia $I_A$ on the first sidewall 124 or the multiplier indicating indicia $I_M$ along the second sidewall 126. The locking member 190 is then screwed against the first sidewall 124 of the bender head 120, releasably securing the locking member 190 and the stop 150 to the bender head 120.

Referring to FIG. 5, a tube 300 that is to be bent is inserted through the closed end 128 of the arcuate channel 122 from right to left, so that a first end 302 of the tube 300, when being bent along the arcuate channel 122, engages the mechanical stop 150. An interior portion 304 of the tube 300 is engaged with the closed end 128 of the arcuate channel 122. A second end 306 of the tube 300 is disposed away from the tube bender 100.

Figure 6:
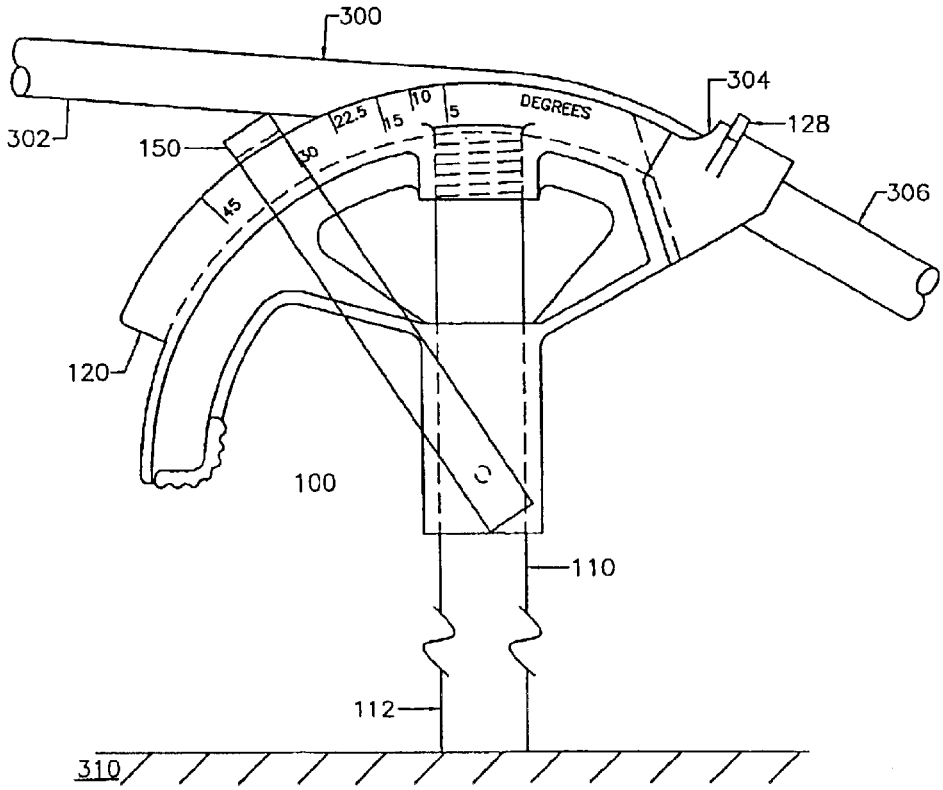
FIG. 6 is a front elevational view of the tube bender and tube of FIG. 5, showing the bending of the tube.

The free end 112 of the handle 110 is placed on a floor 310, as shown in FIG. 6. A force "F", such as by hand pressure, is applied to the tube 300 along the arcuate channel 122 from the interior portion 304 of the tube 300 to the first end 302 of the tube 300 until the first end 302 of the tube 300 engages the mechanical stop 150, as shown in FIG. 6, at which time the user knows that the tube 300 had been bent the desired angular amount.

The user removes the tube 300 from the bender head 120 and measures the tube 300 to determine the actual configuration of the tube 300. If excessive springback is present and the tube 300 is not configured to a configuration acceptable to the user, the user may adjust the location of the mechanical stop 150 along the bender head 120 by loosening the locking member 190 and pivoting the mechanical stop 150 a few degrees away from the closed end 128 according to the type of adjustment required. The locking member 190 is then reengaged with the first sidewall 124 and the tube bending process is repeated until the user is satisfied with the configuration of the bend in the tube 300.

After the user is finished using the tube bender 100 and the tube 300 is removed from the tube bender 100, the user may optionally disengage the locking member 190 from the first sidewall 124 and pivot the mechanical stop 150 away from the bender head 120 to the handle 110 and engaging the mechanical stop 150 with the locking member 198 so that the mechanical stop 150 is securely retained against the handle 110.

Figure 3:
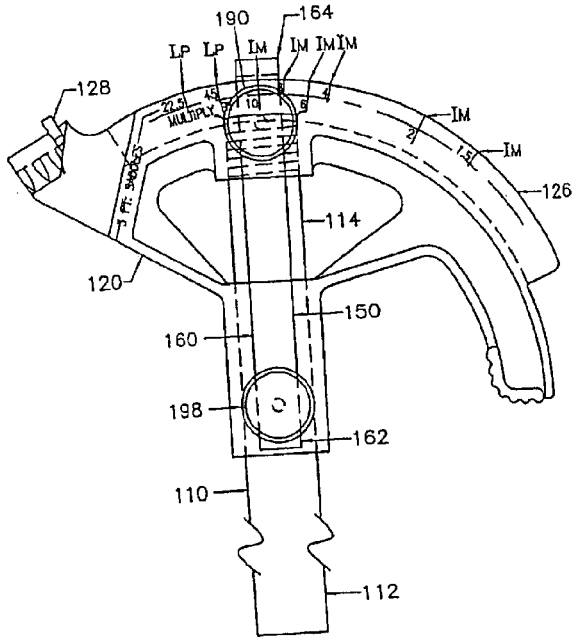
FIG. 3 is a rear elevational view of the tube bender with mechanical stop shown in FIG. 1.
Figure 4:
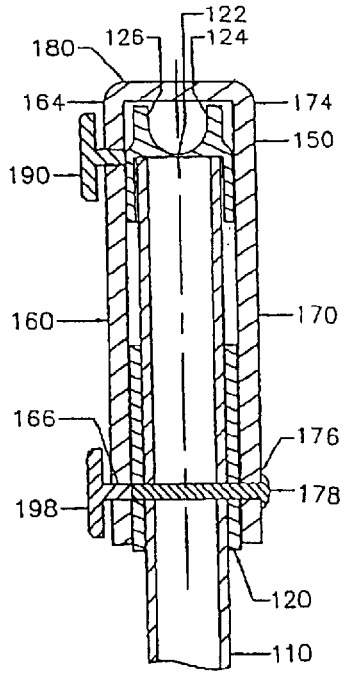
FIG. 4 is a sectional view of the tube bender with mechanical stop as seen along line 4—4 of FIG. 1.

An example of using the tube bender 100 to make a three point saddle is now described. To bend a tube around a 1½ inch (3.75 cm) obstruction, a user makes a first mark on the tube at the beginning of the bend, a second mark on the tube approximately 5 inches (12.5 cm) beyond the first mark, and a third mark approximately 5 inches (12.5 cm) beyond the second mark. The user loosens the locking members 190, 198 and adjusts the mechanical stop 150 to 22.5 degrees on the angle indicating indicia $I_A$ on the first sidewall 124. The user then tightens the locking members 190, 198 to secure the mechanical stop 150 in the desired location. The tube is then inserted into the closed end 128 of the arcuate channel 122 so that the first mark is aligned with the locator point $L_P$ 22.5 on the second sidewall 126, which is shown in FIG. 3. The tube is bent along the arcuate channel 122 until the tube engages the mechanical stop 150. The user loosens the locking members 190, 198 and adjusts the mechanical stop 150 to 45 degrees on the angle indicating indicia $I_A$ on the fist sidewall 124. The user then tightens the locking members 190, 198 to secure the mechanical stop 150 in the desired location. The tube is slid along the arcuate channel 122 until the second mark is aligned with the locator point $L_P$ 45 on the second sidewall 126, which is also shown in FIG. 3. The tube is rotated about its axis 180 degrees and is bent along the arcuate channel 122 until the tube engages the mechanical stop 150. The user loosens the locking members 190, 198 and adjusts the mechanical stop 150 to 22.5 degrees on the angle indicating indicia $I_A$ on the fist sidewall 124. The user then tightens the locking members 190, 198 to secure the mechanical stop 150 in the desired location. The tube is slid along the arcuate channel 122 until the third mark is aligned with the locator point $L_P$ 22.5 on the second sidewall 126. The tube is rotated about its axis 180 degrees and is bent along the arcuate channel 122 until the tube engages the mechanical stop 150. The three-point saddle is now formed and the tube is removed from the tube bender 100.

An example of using the tube bender 100 to make a bend using a multiplier is now described. If a 2 inch (5 cm) offset is desired and the multiplier "4" is selected, the amount of the offset (2) is multiplied by the selected multiplier (4), with a result of "8". The mechanical stop 150 is moved to the $I_M$ labeled "4". A first mark is made on the tube at a desired location and a second mark is made on the tube 8 inches (20 cm) from the first mark. The first mark is placed at the closed end 128 and the tube is bent along the arcuate channel 122 until the tube engages the mechanical stop 150. The tube is rotated 180 degrees and the tube is slid along the arcuate channel 122 until the second mark is aligned with the closed end 128. The tube is again bent along the arcuate channel 122 until the tube engages the mechanical stop 150. The desired offset is made and the tube is removed from the tube bender 100.

Figure 7:
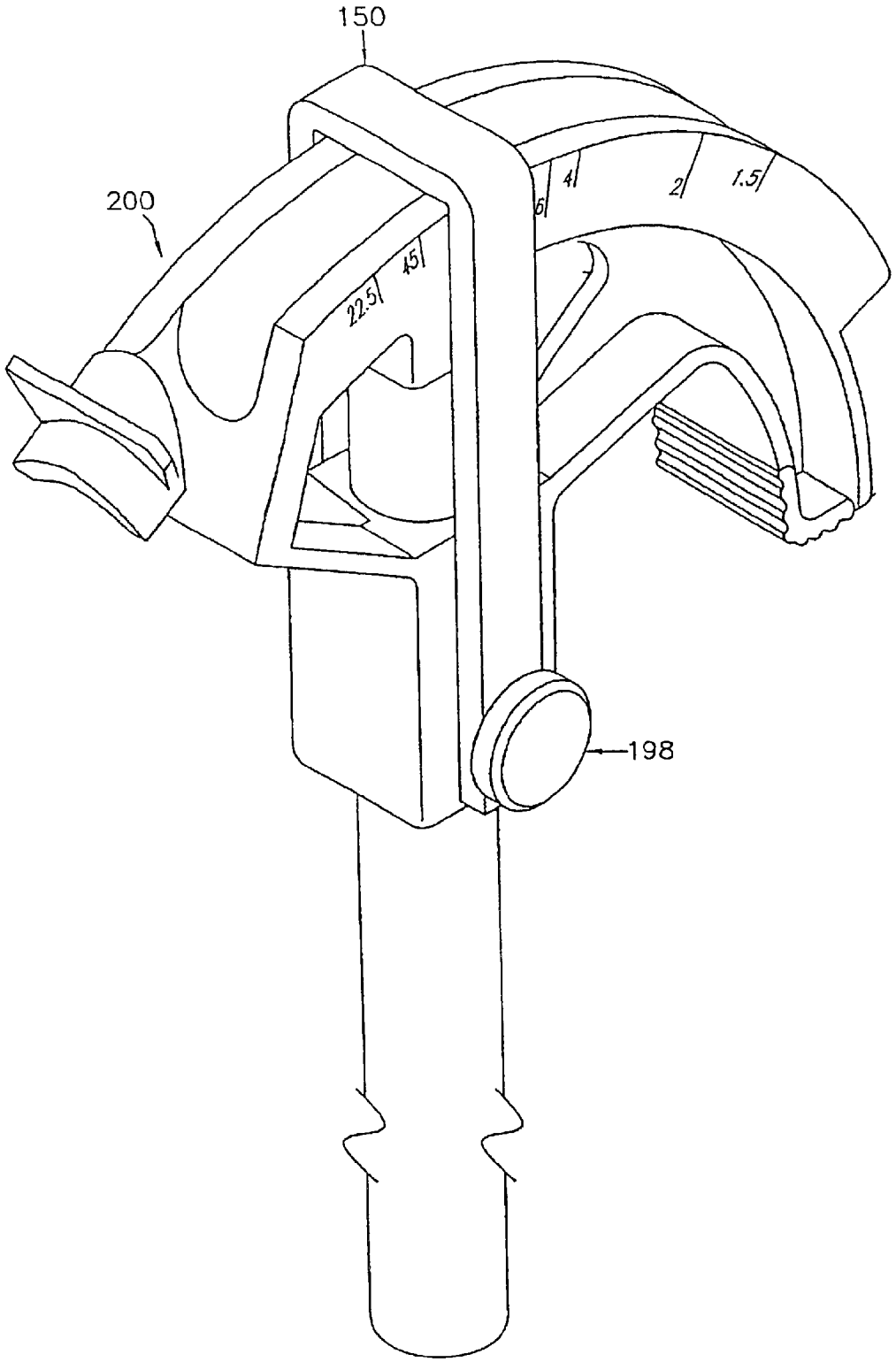
FIG. 7 is a perspective perspective view of a tube bender with mechanical stop according to a second preferred embodiment of the present invention.

An alternate embodiment of a tube bender 200 is shown in FIG. 7. The tube bender 200 is similar to the tube bender 100 described above, with the exception that the locking member 190 on the tube bender 100 is omitted from the tube bender 200, and the locking member 198 is used to releasably secure the mechanical stop 150 in a desired location along the tube bender 200. Operation of the tube bender 200 is similar to the operation of the tube bender 100 as described above, but without the operation of the locking member 190.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

What is claimed is:

1. An adjustable mechanical stop for a tube bender comprising:

an elongated arm having a pivoting end and a free end, wherein the pivoting end is pivotally connectable to a tube bender;

a stop disposed at the free end of the elongated arm, wherein the stop is disposed to engage a tube in the tube bender; and a lock disposed along the elongated arm, wherein the lock is engageable with the tube bender to adjustably secure the stop relative to the tube bender.

2. The adjustable mechanical stop according to claim 1, wherein the mechanical stop is infinitely adjustable along the tube bender.

3. The adjustable mechanical stop according to claim 1, further comprising a locking member disposed proximate to the pivoting end, wherein the locking member is adapted to releasably secure the elongated arm relative to the tube bender.

4. An adjustable mechanical stop for a tube bender comprising:

a generally U-shaped body having a closed end and an open end, wherein the open end is pivotally connectable to a tube bender and wherein the closed end is disposed to engage a tube in the tube bender; and a lock disposed along the generally U-shaped body, wherein the lock is engageable with the tube bender to adjustable secure the generally U-shaped body relative to the bender.

5. The adjustable mechanical stop according to claim 4, wherein the closed end is infinitely adjustable along the tube bender.

6. The adjustable mechanical stop according to claim 4, further comprising a locking member disposed proximate to the open end, wherein the locking member is adapted to releasably secure the generally U-shaped body relative to the tube bender.

7. An improved tube bender comprising:

a tube bender including:

a handle having a free end and a connected end; and a bender head connected to the connected end of the handle, wherein the bender head includes an arcuate channel sized to allow a tube to be disposed therein; and an adjustable stop including:

an elongated arm having a pivoting end pivotally connected to the tube bender and a free end disposed to travel along the arcuate channel;

a stop member connected to the free end of the elongated arm such that the stop member is traversable along the arcuate channel; and a lock disposed along the elongated arm, wherein the lock is engageable with the bender head to adjustably lock the stop relative to the bender head such that, when a tube is disposed within the arcuate channel and bent along the arcuate channel, the stop member engages the tube at a desired location and prevents further bending of the tube along the arcuate channel.

8. The improved tube bender according to claim 7, wherein the stop member is infinitely adjustable along the arcuate channel.

9. The improved tube bender according to claim 7, further comprising a locking member disposed proximate to the pivoting end, wherein the locking member is adapted to releasably secure the elongated arm relative to the tube bender.

10. The improved tube bender according to claim 7, wherein the bender head further comprises a plurality of multiplier indicating indicia disposed thereon.

11. The improved tube bender according to claim 10, wherein the plurality of multiplier indicating indicia comprise a plurality of whole numbers.

12. The improved tube bender according to claim 7, wherein the bender head further comprises a plurality of angle indicia disposed thereon.

13. The improved tube bender according to claim 7, wherein the elongated arm is generally U-shaped and comprises an open portion and a closed portion.

14. The improved tube bender according to claim 13, wherein stop member is disposed at the closed portion of the generally U-shaped member.

15. A method of bending a tube in a tube bender comprising:

providing a tube bender including:

a handle having a free end and a connected end; and a bender head connected to the connected end of the handle, wherein the bender head includes an arcuate channel sized to allow a tube to be disposed therein; and an adjustable stop including:

an elongated arm having a pivoting end pivotally connected to the tube bender and a free end disposed to travel along the arcuate channel;

a stop member connected to the free end of the elongated arm such that the stop member is traversable along the arcuate channel; and a lock disposed along the elongated arm, wherein the lock is engageable with the bender head to adjustably lock the stop member relative to the bender head such that, when a tube is disposed within the arcuate channel and bent along the arcuate channel, the stop member engages the tube at a desired location and prevents further bending of the tube along the arcuate channel;

pivoting the stop member along the arcuate channel to a desired location;

engaging the lock to adjustably lock the stop member to the bender head at the desired location;

inserting a tube into the arcuate channel;

bending the tube along the arcuate channel until the tube engages the stop member; and removing the tube from the tube bender.

16. The method according to claim 15, further comprising, after bending the tube:

disengaging the lock;

repositioning the stop member to a second location;

reengaging the lock to adjustably lock the stop member to the bender at the second location;

adjusting the tube relative to the arcuate channel; and bending the tube an additional time along the arcuate channel until the tube engages the stop member.

* * * * *